US009896251B2

(12) United States Patent
Breisinger et al.

(10) Patent No.: US 9,896,251 B2
(45) Date of Patent: Feb. 20, 2018

(54) SEALING CAP FOR A CLEANING AGENT CONTAINER

(71) Applicant: Henkel AG & Co. KGaA, Duesseldorf (DE)

(72) Inventors: Julia Breisinger, Duesseldorf (DE); Katja Gerhards, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/405,002

(22) Filed: Jan. 12, 2017

(65) Prior Publication Data

US 2017/0121078 A1 May 4, 2017

Related U.S. Application Data

(63) Continuation of application No. PCT/EP2015/064445, filed on Jun. 25, 2015.

(30) Foreign Application Priority Data

Jul. 14, 2014 (DE) ..... 10 2014 213 603

(51) Int. Cl.
*B65D 51/32* (2006.01)
*B65D 41/04* (2006.01)
(Continued)

(52) U.S. Cl.
CPC ..... *B65D 51/32* (2013.01); *A46B 5/0095* (2013.01); *A46B 9/02* (2013.01); *A46B 15/0055* (2013.01); *B65D 41/04* (2013.01)

(58) Field of Classification Search
CPC ..... A46B 7/04; A46B 7/042; A46B 7/046; A46B 15/0051; A46B 15/0055; B65D 51/32
See application file for complete search history.

(56) References Cited

U.S. PATENT DOCUMENTS 695,945 A * 3/1902 Pfeifer ..... A46B 7/04 401/24
2,724,849 A 11/1955 Schultz
(Continued)

FOREIGN PATENT DOCUMENTS

| | | |
|---|---|---|
| DE | 20004275 U1 | 9/2000 |
| EP | 0068347 A1 | 1/1983 |
| WO | 2014/004456 A1 | 1/2014 |

OTHER PUBLICATIONS

PCT International Search Report (PCT/EP2015/064445) dated Aug. 14, 2015.

*Primary Examiner* — Jennifer C Chiang
*Assistant Examiner* — Bradley Oliver
(74) *Attorney, Agent, or Firm* — Thomas G. Krivulka

(57) ABSTRACT

The invention relates to a sealing cap (10) for cleaning agent containers (1), comprising a cup-shaped cap body (11) and a brush device, wherein the cap body (11) has a cap base (13) on a closed end (18), and a cover surface (14) that extends from the cap base (13) to an open end (15) of the cap body (11). The invention is characterized in that the brush device is formed as a brush attachment (12) having a ring (25) and a base plate (24), wherein the ring (25) can be attached to the closed end (18) of the cap body using the base plate (24), and having at least one air opening (27, 35) suitable for permitting an equalization of the pressure when attaching the brush attachment (12) to the closed end (18) of the cap body (11).

10 Claims, 4 Drawing Sheets

(51) Int. Cl.

| | |
|---|---|
| ***A46B 15/00*** | (2006.01) |
| ***A46B 9/02*** | (2006.01) |
| ***A46B 5/00*** | (2006.01) |

(56) References Cited

U.S. PATENT DOCUMENTS

| | | | | |
|---|---|---|---|---|
| 5,549,209 | A * | 8/1996 | Weissman | B65D 41/26 215/228 |
| 5,842,784 | A * | 12/1998 | Contrasto | A46B 7/04 15/176.1 |
| 8,684,614 | B2 | 4/2014 | Chawla et al. | |
| 2003/0198502 | A1* | 10/2003 | Maloney | B65D 47/242 401/265 |
| 2007/0116507 | A1* | 5/2007 | Fagelman | A46B 7/04 401/137 |
| 2007/0201941 | A1* | 8/2007 | Koptis | A46B 7/02 401/290 |
| 2009/0226237 | A1 | 9/2009 | Kraus et al. | |
| 2009/0314738 | A1 | 12/2009 | Siacunco et al. | |
| 2010/0239359 | A1* | 9/2010 | Repp | A46B 7/04 401/282 |
| 2014/0326628 | A1* | 11/2014 | Fox | B65D 25/00 206/459.5 |
| 2016/0010256 | A1* | 1/2016 | Cardinal | D06F 3/04 68/220 |
| 2016/0095423 | A1* | 4/2016 | Cotter | A46B 11/00 15/106 |
| 2017/0121071 | A1* | 5/2017 | Gerhards | A46B 5/0095 |
| 2017/0121079 | A1* | 5/2017 | Gerhards | B65D 25/54 |

* cited by examiner

SEALING CAP FOR A CLEANING AGENT CONTAINER

FIELD OF THE INVENTION

The present invention generally relates to a closure cap for a cleaning agent container, the closure cap comprising a cup-shaped cap body and a brush device.

BACKGROUND OF THE INVENTION

WO 2014/004456 A1 discloses a closure cap of this type in the form of a dosing cap. The cap body comprises a cap base on a closed end and a lateral surface which extends from the cap base to an open end of the cap body. The brush device having a plurality of bristles and the cap body are integrally formed in this case. The brush device having the bristles can be used to pretreat an object to be cleaned, the cleaning agent being applied by means of the bristles to a badly soiled region.

For uses in which the option of pretreating by means of the brush device is not required, a closure cap of this type is not suitable or is far too complex to construct.

A closure cap for a cleaning agent container is also known from DE 20004275 U1, the brush device containing a separate bristle carrier plate that is latchably connected to the cap body in one embodiment in this document. The two-part form of the brush carrier plate and cap body allows separate use of the cap body as a closure cap having no brush device; however, the cap body is constructed in a complex manner in this case too, in order to permit the latching connection to the brush carrier plate.

The object of the invention is therefore that of providing a closure cap comprising a cup-shaped cap body and a brush device, in which the cap body can be universally used and the cap body and brush device are as simple as possible to handle. The terms "cleaning agent" and "cleaning agent container" include washing agents and washing agent containers, respectively.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A closure cap (10) for a cleaning agent container (1), comprising a cup-shaped cap body (11) and a brush device, the cap body (11) having a cap base (13) at a closed end (18) and a lateral surface (14) which extends from the cap base (13) to an open end (15) of the cap body (11), characterized in that the brush device is formed as a brush attachment (12) which has a ring (25) and a base plate (24), the ring (25), together with the base plate (24), being able to be fitted onto the closed end (18) of the cap body and having at least one air opening (27, 35) which is suitable for permitting pressure equalization when the brush attachment (12) is fitted onto the closed end (18) of the cap body (11).

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
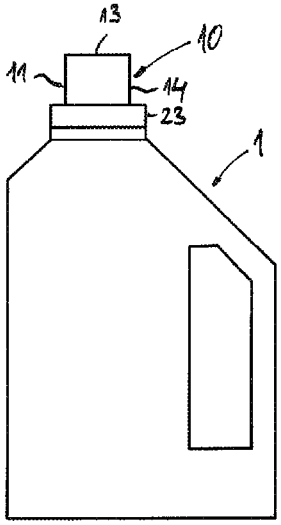
FIG. 1 shows a cleaning agent container comprising a closure cap.

The following detailed description of the invention is merely exemplary in nature and is not intended to limit the invention or the application and uses of the invention. Furthermore, there is no intention to be bound by any theory presented in the preceding background of the invention or the following detailed description of the invention.

The instant closure cap (10) for a cleaning agent container (1), comprises a cup-shaped cap body (11) and a brush device, the cap body (11) having a cap base (13) at a closed end (18) and a lateral surface (14) which extends from the cap base (13) to an open end (15) of the cap body (11), characterized in that the brush device is formed as a brush attachment (12) which has a ring (25) and a base plate (24), the ring (25), together with the base plate (24), being able to be fitted onto the closed end (18) of the cap body and having at least one air opening (27, 35) which is suitable for permitting pressure equalization when the brush attachment (12) is fitted onto the closed end (18) of the cap body (11).

According to the invention, the brush device is formed as a brush attachment which comprises a ring and a base plate, the ring, together with the base plate, being able to be fitted onto the closed end and having at least one air opening which is suitable for permitting pressure equalization when the brush attachment is fitted onto the closed end of the cap body. After successful fitting, the ring of the brush attachment surrounds the lateral surface of the cap body on the outside.

If a substantially rotationally symmetrical cap body having a circular cap base is assumed, the ability to be fitted onto the closed end of the cap body is achieved in that an inside diameter of the ring of the brush attachment is larger than an outside diameter of the cap body at the closed end. In this case, the ring surrounds the closed end of the cap body in the radial direction.

The cap body does not necessarily have to be rotationally symmetrical. For example, the cap base may also be polygonal (for example hexagonal or octagonal), the cap body in that case substantially being a straight prism, the side edges of which are parallel and equal in length, and having said polygonal cap base as a base. In this context, the cross section of the ring of the brush attachment does not have to be circular, but can correspondingly deviate therefrom. For an octagonal cap base, for example, the ring may also be octagonal.

If the brush attachment is fitted onto the closed end of the cup-shaped cap body by means of an edge facing away from the base plate, an intermediate space is delimited between the cap body and the brush attachment. Air is located in this intermediate space which needs to escape when the brush attachment is placed or pushed further onto the closed end. If this air cannot escape, it is virtually impossible to push the brush attachment so far onto the closed end of the cap body that the cap base and the base plate of the brush attachment meet. The volume of the intermediate space would then be very small or equal to zero. Without the air opening according to the invention, an excess pressure would build up in the intermediate space which would make it difficult to fit the brush attachment. Air can escape from the intermediate space to the outside through the air opening, resulting in pressure equalization between the intermediate space and the surroundings.

In an embodiment of the invention, the brush attachment is detachably connected to the closed end after successful fitting. It is thus possible to remove a fitted brush attachment from the cap body again. In this case, the air opening makes it easier to remove the brush attachment, since, assuming there is no intermediate space or a very small intermediate space between the cap body and the base plate of the brush attachment, the intermediate space increases in volume due to the brush attachment being pulled off the closed end of the cap body. Thus, a negative pressure is generated without an air opening, which pressure makes it more difficult to pull off the brush attachment.

The cap base can be connected to the lateral surface by means of a rounded edge. In other words, the cap base can transition, by means of the rounded edge, into the lateral surface without discontinuity and without offset.

In an embodiment, an outer contour of the cap body at the closed end substantially matches an inner contour of the brush attachment. In this case, the outer contour of the cap body is defined by an outer wall of the lateral surface, an outer wall of the cap base and, if present, by an outer wall of a transition between the lateral surface and cap base. The inner contour of the brush attachment is defined by the inner wall of the ring and the inner wall of the base plate and, if applicable, an inner wall of the transition between the ring and the base plate. The fact that the inner contour and outer contour match means that it is possible for the intermediate space between the cap body and the brush attachment to completely disappear when the brush attachment is fitted in the final position.

If the outer contour of the cap body and the inner contour of the brush attachment match, for a cap body having a rounded edge between the cap base and lateral surface, the brush attachment would also have such a rounded edge, at least at the inner contour. In a preferred embodiment, an outer contour of the brush attachment follows the inner contour of the brush attachment.

The brush attachment can have support elements on an inner face for resting on the cap body. A spacing between the ring and the base plate on the one hand and the cap body on the other hand is bridged by the support elements, for example when the inner contour of the brush attachment does not fully match the outer contour of the cap body.

The at least one air opening can be formed in the base plate of the brush attachment. It is also possible for a plurality of air openings to be formed in the base plate, it being possible, for example, to arrange said openings at an equal spacing from the center of the base plate in the case of a circular base plate. When there are two air openings, for example, these can be arranged diametrically to the center of the base plate.

If a plurality of air openings are provided, these can differ from one another in shape, position and size. However, it is also possible for only uniform air openings to be used which are arranged in a particular pattern (for example in a circle, spaced apart equally from one another in the circumferential direction).

In an embodiment of the invention, the air opening is formed as a gap which extends along the ring in the axial direction. If, for example, four such gaps are provided in the axial direction, the ring would therefore be divided into four segments. The gap or gaps can extend in the axial direction along the ring from the base plate to the edge of the ring facing away from the base plate. In this case, the edge would be interrupted by the gaps. It is also possible for the edge to be continuous around the periphery, the gaps in this case not extending along the entire axial length of the ring.

An outside diameter at the closed end of the cap body can differ from an outside diameter at the open end of the cap body. Preferably, the outside diameter at the closed end is smaller than the outside diameter at the open end. The lateral surface can taper at least in the region of the closed end such that, during production thereof, the closed end of the cap body can be cast from an injection-molding mold-half. The difference in the outside diameters can be at least 2 percent, based on the larger outside diameter. The outside diameters can be measured at a small axial spacing of 0.5 or 1 cm from the outer wall of the cap base, between an edge of the open end of the cap body.

The closure cap can be formed as a dosing cap, the cup-shaped cap body enclosing an interior space which is only open at the open end. The volume of the interior space can be 30 to 150 ml.

In a preferred embodiment, the brush attachment can be fitted onto the open end. The brush attachment or the cap body can comprise connection means such that a brush attachment fitted onto the closed end and a brush attachment fitted onto the open end can be removed in each case only by overcoming a lifting force, even if the outside diameters are different at the closed and open ends, as in an embodiment described above. The lifting force (in the axial direction of the cap body, perpendicular to the cap base) should be greater than 2 N. Preferably, the lifting force for the closed end and the open end is greater than 20 or even 100 N in each case.

In an embodiment, the connection means have resilient restoring forces for the ring. If the brush attachment is placed on the open end or the closed end of the cap body, the ring expands accordingly. The resilient restoring forces occurring in the process provide a firm hold of the brush attachment on the cap body. If the material (for example silicone, elastomeric material) is selected accordingly, the two ends of the cap body can thus both be held firmly in position, even if the outside diameters at the closed end and at the open end differ from one another. The above-mentioned requirement in one embodiment, that the inside diameter of the ring needs to be larger than the outside diameter of the cap body, is to be understood here to mean that the ring can be expanded to a correspondingly large inside diameter.

The connection means can comprise adhesive. Alternatively or in addition to the resilience of the ring of the brush attachment, corresponding adhesive can be applied between the brush attachment and the cap body. It is possible in this case to apply the adhesive to the outer wall of the cap base and, provided that the adhesive is still fluid or has not yet set, to push the brush attachment onto the closed end of the cap body until there is an adhesive connection between the cap base and the base plate of the brush attachment. It is also possible to use adhesive strips which are arranged on the lateral surface, the ring or on the rounded edge between the cap base and the lateral surface.

Figure 2:
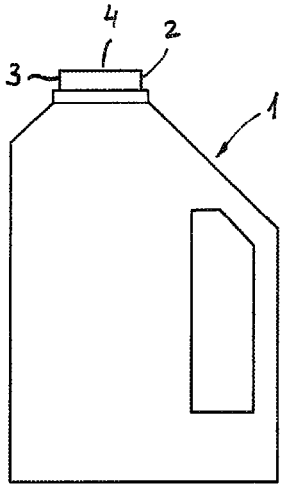
FIG. 2 shows the cleaning agent container from FIG. 1 without a closure cap.

The invention is described in more detail with reference to the embodiments shown in the figures, in which:

FIGS. 1 and 2 show a cleaning agent container denoted by reference sign 1. The cleaning agent container 1 in FIG. 1 is closed by a closure cap 10. The closure cap 10 can be connected to the cleaning agent container 1 by means of an outer thread 2 which is molded on a container neck 3 of the cleaning agent container 1. The container neck 2 surrounds a circular container opening 4. The closure cap 10 comprises a cup-shaped cap body 11 and a brush attachment (not shown in FIG. 1 but shown, for example, in FIG. 3 and denoted there by reference sign 12).

Figure 3:
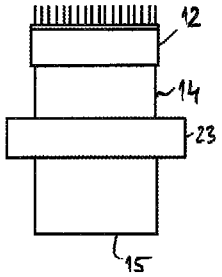
FIG. 3 shows the closure cap from FIG. 1 comprising a cap body and a brush attachment.
Figure 4:
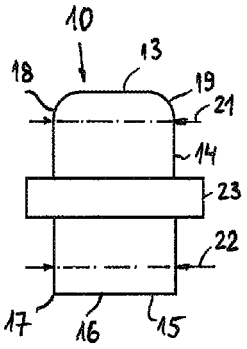
FIG. 4 shows another embodiment of the cap body.
Figure 5:
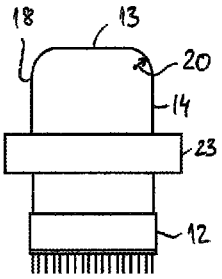
FIG. 5 shows the cap body from FIG. 4 comprising a brush attachment on an open end of the cap body.

FIGS. 3 to 5 show different embodiments of the closure cap 10 in cross section. The cap body 11 comprises a cap base 13 and a lateral surface 14 which extends from the cap base 13 to an open end 15 of the cap body 11. At the open end 15, the cap body 11 has a circular opening 16 which is delimited by a circular edge 17. At an end opposite the open end 15, the cap body 10 is closed (closed end 18). If the cap body 11 is placed upside down, with the cap base 13 facing down, a specific quantity of cleaning agent can be introduced into the cap body 11 through the circular opening 16. The cap body 11 can thus be used as a dosing cap.

In the embodiment in FIG. 4 and FIG. 5, the cap base 13 can be connected to the lateral surface 14 by means of a rounded edge 19. A radius of curvature 20 (see FIG. 5) can be 2 to 8 millimeters, for example.

The cap body from FIG. 3 is not intended to have a rounded edge shown in FIGS. 4 and 5, but rather is intended to have the shape of the cap body according to FIG. 1. While in FIG. 3 the brush attachment 12 is placed on the closed end 18, in FIG. 5 the brush attachment 12 is placed on the lower or open end 15. An outside diameter 21 at the closed end 19 of the cap body 10 and an outside diameter 22 at the open end 16 of the cap body 10 are in this case equal. However, the lateral surface 14, which extends from the cap base 13 to the open end 16, can also taper such that the outside diameter 21 is smaller than the outside diameter 22. It is also possible for the lateral surface 14 to taper as far as a skirt 23, which is arranged approximately halfway between the closed end 18 and the open end 16, and then to continue to extend cylindrically between the skirt 23 and the open end 16. It is also conceivable for the lateral surface 14 to be composed of a plurality of cylinder pieces that have different outside diameters and are placed one on top of the other.

The skirt 23 is open at a side facing the open end 16 and comprises, on the inner face thereof, an inner thread (not shown here) which can be screwed onto the outer thread 3 of the container neck 2. When viewed together with FIG. 1, it is clear that the part of the lateral surface 14 located between the skirt 23 and the open end 16 is arranged, in the closed position of the closure cap 10 (see FIG. 1), inside the container neck 3 or in the cleaning agent container 1.

Figure 6:
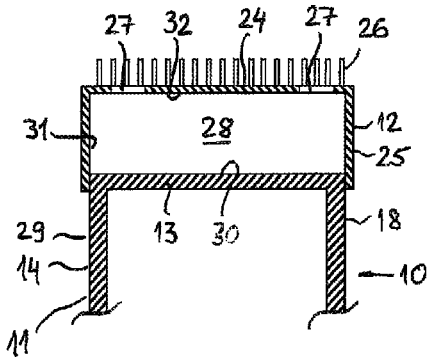
FIG. 6 is a cross section of a closed end of the cap body comprising a brush attachment.
Figure 7:
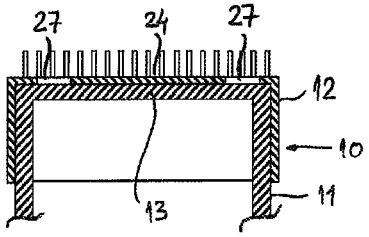
FIG. 7 shows the cap body from FIG. 6 comprising a brush attachment in the final position.

FIGS. 6 and 7 show the closed end 18 of the cap body 11 according to FIG. 1 or FIG. 3 in cross section. In this case, FIG. 6 shows the brush attachment 12 at a certain spacing from the cup-shaped cap body 11. Conversely, FIG. 7 shows the brush attachment 12 in a final position in relation to the cap body 11.

The brush attachment 12 comprises a circular base plate 24 and a ring 25. A plurality of bristles 26 is arranged on the base plate 24, the length of which bristles can be 8 to 12 millimeters, for example. A bristle diameter of a single bristle 26 is preferably approximately 0.5 millimeters.

Two air openings 27 are incorporated in the base plate so that air located in an intermediate space 28 between the base plate 24 and the cap base 23 (see FIG. 6) can escape when the brush attachment 12 is pushed in the direction of the cap base 13, from the position shown in FIG. 6 into the final position (see FIG. 7).

An outer contour of the cap body 11 at the closed end 18 is defined by an outer wall 29 of the lateral surface 14 and an outer wall 30 of the cap base 13. As can be seen in particular in FIG. 7, the outer contour of the cap body 11 matches an inner contour of the brush attachment 12, the inner contour of the brush attachment 12 being defined by an inner wall 31 of the ring 25 and an inner wall 32 of the base plate 24. When, starting from the final position shown in FIG. 7, the brush attachment 12 is to be removed from the cap body 11, air can flow through the air openings 27 into the gap or intermediate space 28 then occurring between the base plate 24 and cap base 13. There is thus pressure equalization between the intermediate space 28 and the surroundings. It is not possible for the intermediate space 28 to have either an excess pressure or a negative pressure which makes the fitting or removal of the brush attachment 12 more difficult.

Figure 8:
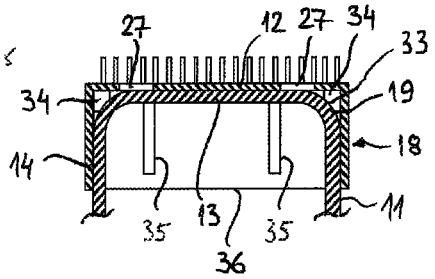
FIG. 8 is a cross section of another embodiment of the cap body and brush attachment.

FIG. 8 shows an embodiment of the cap body 11 which, based on the embodiment in FIG. 4 and FIG. 5, comprises the rounded edge 19. An outer wall 33 of the rounded edge 19 or of the transition between the cap base 13 and the lateral surface 14 influences the outer contour of the cap body 11 at the closed end 18. Since the brush attachment 12 does not comprise a corresponding round transition between the base plate 24 and the ring 25, but rather is angular, the outer contours of the cap body 11 and the brush attachment 12 do not completely match. To compensate for this, support elements 34 are arranged on an inner face of the brush attachment 12 and are used for resting the brush attachment 12 on the cap body 11. In the view in FIG. 8, two support elements offset by 180 degrees can be seen. Four or more support elements may also be provided.

In addition to the air openings 27 in the base plate 24, the brush attachment 12 comprises further air openings 35 on the ring 25 which are formed as axially extending gaps. The air openings 28 extend in this case from the base plate 24 to a peripheral edge 36 of the ring 25. It should be noted here that, in the embodiment in FIG. 8, the gap-like air openings 28 not only can complement the air openings 27 but can also replace them.

Figure 9:
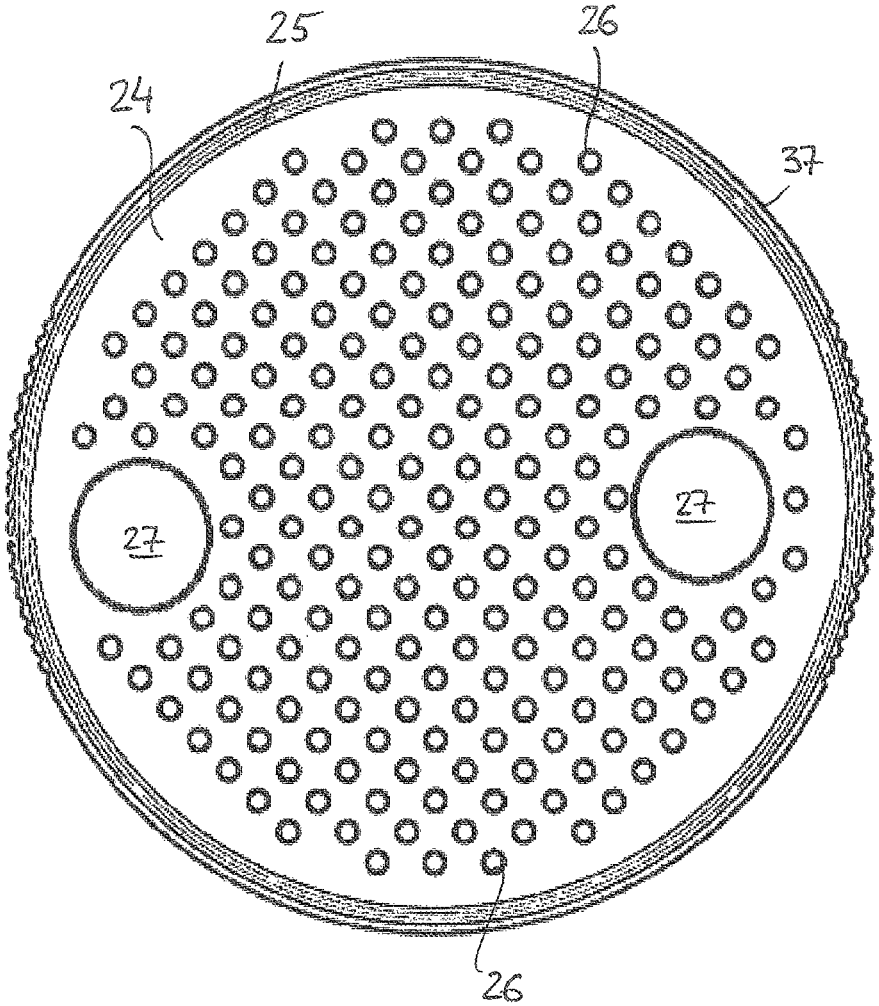
FIG. 9 is a plan view of another embodiment of the brush attachment.

FIG. 9 shows the brush attachment 12 from above. The circular base plate 24 can be seen, on which the individual bristles 26 are in a regular pattern. The air openings 27 are circular, it being intended for an opening diameter to be approximately 8 mm in this case. Corrugations 38 can be seen on an outer wall 37 of the ring 25, as a result of which the brush attachment 12 has a better grip and thus the fitting and removal is made easier.

LIST OF REFERENCE SIGNS

1 Cleaning agent container
2 Outer thread
3 Container neck
4 Container opening
10 Closure cap
11 Cap body
12 Brush attachment
13 Cap base
14 Lateral surface
15 Open end

16 Opening
17 Edge
18 Closed end
19 Edge
20 Radius of curvature
21 Outside diameter
22 Outside diameter
23 Skirt
24 Base plate
25 Ring
26 Bristle
27 Air opening
28 Intermediate space
29 Outer wall
30 Outer wall
31 Inner wall
32 Inner wall
33 Outer wall
34 Support element
35 Air opening
36 Edge
37 Outer wall
38 Corrugation While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A closure cap for a cleaning agent container, comprising a cup-shaped cap body and a brush device, the cap body having a cap base at a closed end and a lateral surface which extends from the cap base to an open end of the cap body, wherein the brush device is formed as a brush attachment which has a ring and a base plate, the ring, together with the base plate, being able to be fitted onto the closed end of the cap body and having at least one air opening which is suitable for permitting pressure equalization when the brush attachment is fitted onto the closed end of the cap body.

2. The closure cap according to claim 1, wherein the brush attachment is detachably connected to the closed end after successful fitting.

3. The closure cap according to claim 1, wherein the cap base is connected to the lateral surface by means of a rounded edge.

4. The closure cap according to claim 1, wherein an outer contour of the cap body at the closed end substantially matches an inner contour of the brush attachment.

5. The closure cap according to claim 1, wherein the brush attachment comprises support elements on an inner face for resting on the cap body.

6. The closure cap according to claim 1, wherein the air opening is formed as a gap which extends in the axial direction along the ring.

7. The closure cap according to claim 1, wherein an outside diameter at the closed end of the cap body differs from an outside diameter at the open end.

8. The closure cap according to claim 1, wherein the brush attachment or the cap body comprises connection means such that a brush attachment fitted onto the closed end and a brush attachment fitted onto the open end can be removed in each case only by overcoming a lifting force that is greater than 2 N.

9. The closure cap according to claim 8, wherein the lifting force is greater than 20 N.

10. The closure cap according to claim 8, wherein the connection means comprises adhesive.

* * * * *